United States Patent [19]

Korsunsky et al.

[11] Patent Number: 4,929,194

[45] Date of Patent: May 29, 1990

[54] POST MEANS FOR USE WITH A MOLDED CONNECTOR

[75] Inventors: Iosif Korsunsky, Harrisburg; Richard C. Schroepfer, Thompsontown, both of Pa.

[73] Assignee: AMP Incorporated, Harrisburg, Pa.

[21] Appl. No.: 234,362

[22] Filed: Aug. 18, 1988

[51] Int. Cl.[5] ..... H01R 13/13

[52] U.S. Cl. ..... 439/571; 439/328

[58] Field of Search ..... 439/326, 572, 571, 560, 439/544, 554, 557, 558, 326, 328, 357, 358, 59, 62, 78; 264/1.5, 272.14, 318, 334

[56] References Cited

U.S. PATENT DOCUMENTS

| | | | |
|---|---|---|---|
| 3,297,974 | 1/1967 | Pittman | 439/331 |
| 4,477,132 | 10/1984 | Moser | 339/14 |
| 4,713,013 | 12/1987 | Regnier et al. | 439/326 X |
| 4,737,120 | 4/1988 | Crabbe | 439/326 |

*Primary Examiner*—Neil Abrams
*Assistant Examiner*—Khiem Nguyen
*Attorney, Agent, or Firm*—Bruce J. Wolstoncroft

[57] ABSTRACT

A connector (2) has reliable projections (4, 6) which extend from the housing (12). Each projection (4, 6) has cavities (12, 34) which are provided proximate thereto. Ribs (26, 50) extend from the sidewalls of the cavities toward the projections. The ribs (26, 50) cooperate with intermediate portions (20, 46), such that as forces are applied to free end portions (22, 48) of the projections (4, 6), the intermediate portions (20, 46) engage the ribs (26, 50). The engagement of the intermediate portions and the ribs insures that the moment, which is created by force (F), will be distributed to the intermediate portions rather than to a fixed end portion (18, 44) of the projection, thereby insuring that a reliable structural interconnection is made.

16 Claims, 3 Drawing Sheets

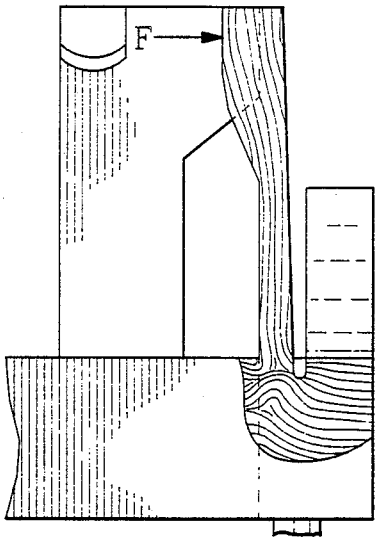
FIG.6
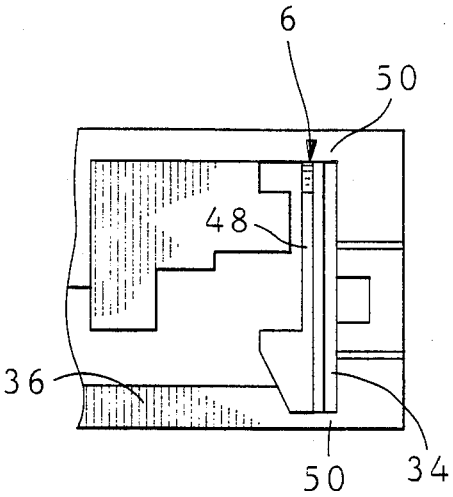
FIG.7
FIG.8
PRIOR ART
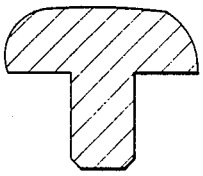
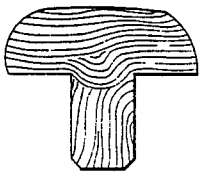
FIG.9
PRIOR ART

POST MEANS FOR USE WITH A MOLDED CONNECTOR

FIELD OF THE INVENTION

The invention is directed to an improved post means which is strengthened to prevent the structural failure of the post means. In particular, the invention is directed to a post means which has ribs provided proximate thereto, the ribs cooperating the post means to insure the structural integrity of the post means.

BACKGROUND OF THE INVENTION

Molded connectors are commonly used in many various applications. Often times, these connectors have projections extending from major surfaces thereof. An example of such a projection is illustrated in FIG. 8. As is shown, a mounting post extends from a major surface of the connector for cooperation with a printed circuit board or the like. Other types of projections which extend from the housing of the molded connectors can include various latches, etc.

As the connector is mated to a mating connector or circuit board, the projections which extend from the major surface of the connector generally have a force applied to a free end thereof. This force can be caused by the dimensional variation (due to tolerance limits) between the mating connectors. The force generally has a component which is provided in a plane which is perpendicular to the axis of the projection. Using the mounting post of FIG. 8 as an example, as the mounting post is inserted into an opening of a printed circuit board or the like, the misalignment of the connector and board causes the opening to apply a force at the free end of the mounting post. This force has a component which is positioned in a plane which is perpendicular to the axis of the mounting post. This perpendicular force causes a moment to be present around the fixed end of the post. As the moment can be relatively large, the moment can cause failure of the post, thereby rendering the connector ineffective.

The failure of the posts is of particular concern in molded connectors, due to the flow of the material in the housing of the connectors. As is shown in FIG. 9, the molded material flows into the post of the connector when the housing of the connector is molded. As is shown in FIG. 9, the material flows essentially horizontal in the main portion of the housing, and essentially vertical in the post. The transition between these divergent flows occurs at approximately the fixed end of the post, or where the projection is fixed to the housing. The irregular flow of material at the fixed end causes the fixed end to be weaker than other portions of the post, primarily because of the lack of fiber orientation in this transition area. Consequently, when the moment is applied about the fixed end, the fixed end is prone to structural failure. The structural failure of the post renders the connector essentially ineffective.

The same results occur during shipping of the parts, if the connectors are not packaged properly. In other words, any force applied to the posts which results in a moment being applied to the fixed end, can result in the structural failure of the posts. It should be noted that any projection (latches, etc.) extending from a major surface of the connector is prone to failure for the same reasons described.

It would therefore be beneficial to provide a post or other projection on a molded housing which would not be prone to failure, no matter the relative strength of the forces applied thereto.

SUMMARY OF THE INVENTION

The invention is directed to a molded connector which has molded projections extending therefrom. The molded projections are configured to cooperate with ribs of the connector to provide the projections with the strength characteristics required to insure that the projections will not fail.

The connector is of the type which comprises a housing which has a first major surface and an oppositely facing second major surface. A cavity is provided in the first major surface and extends toward the second major surface of the housing The cavity has a bottom surface which is spaced from the first major surface.

A projection means extends from the bottom surface of the cavity beyond the first major surface of the housing. A base portion or fixed end of the projection means is provided proximate the bottom surface of the cavity and a top portion or free end of the projection means is provided beyond the first major surface of the housing. The projection means has a midportion which extends from the top portion to the base portion. Rib means extend from the housing into the cavity proximate the first major surface, the rib means are provided to cooperate with the projection means.

As forces are applied to the top end of the projection means, the forces are distributed to the midportion of the projection means, rather than to the base of the projection means. This distribution of forces is due to the cooperation of the ribs with the midportion, and prevents the projection means from pivoting about the base portion, thereby, insuring that the projection means will not fail as a force is applied thereto.

BRIEF DESCRIPTION OF THE DRAWINGS

FIG. 6 is a view of the latching means of the connector, similar to FIG. 5, showing a representation of how the reinforcement fibers flow in the housing and in the latching means.

FIG. 7 is a top view of the latching means and a portion of the housing, showing the ribs extending from the housing to cooperate with the latching means.

FIG. 8 is a view of a post of a connector which is produced according to the teaching of the prior art.

FIG. 9 is a of the post of the connector of the prior art, similar to FIG. 8, showing a representation of the flow of reinforcement fibers in the housing and in the post.

DETAILED DESCRIPTION OF THE INVENTION

Figure 1:
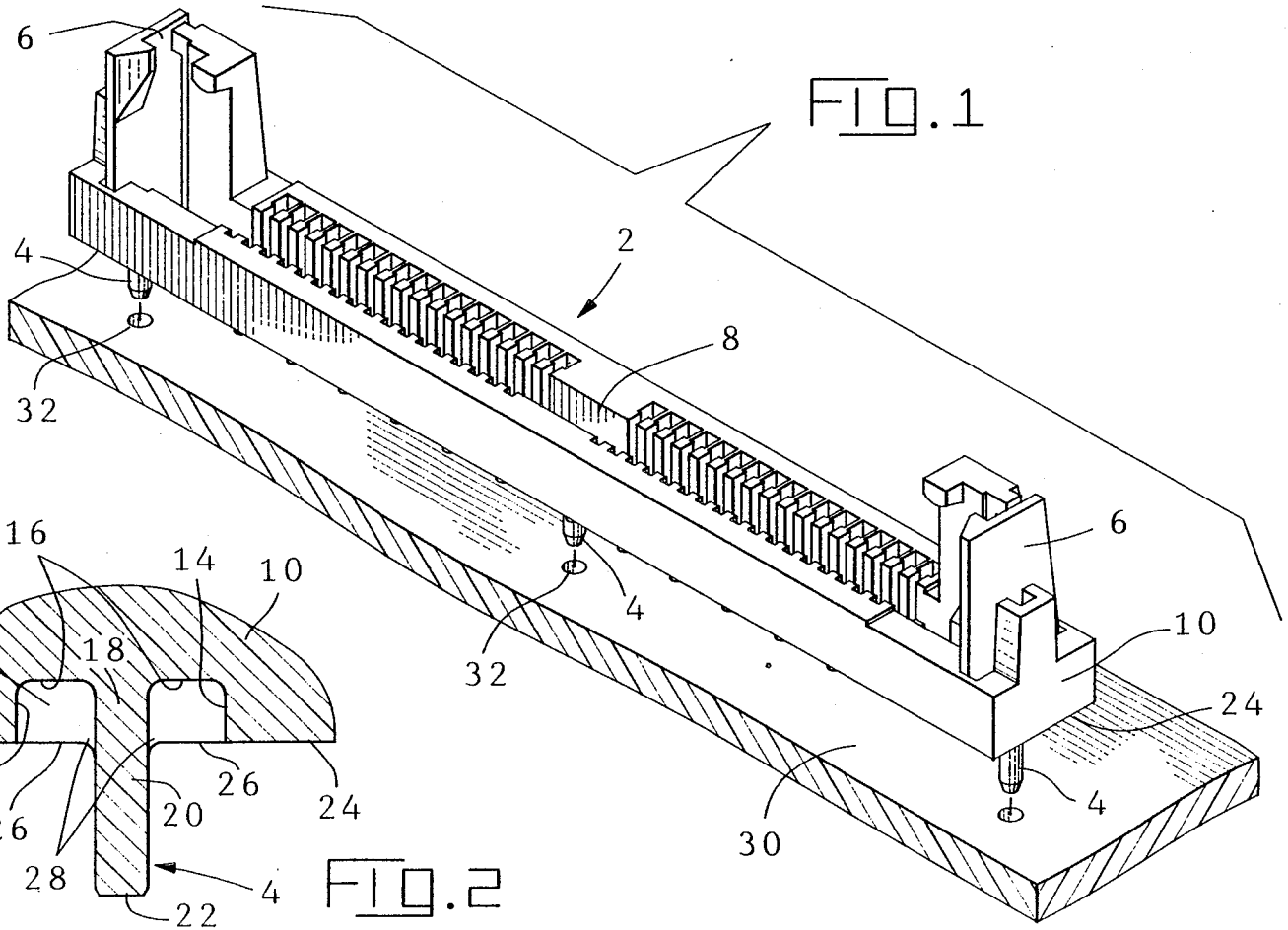
FIG. 1 is a perspective view of a connector which incorporates the present invention therein.

As is shown in FIG. 1, a molded electrical connector 2 is provided with various projections which extend therefrom. The projections include mounting posts 4 for mounting of the connector and latches 6 for maintaining a matable printed circuit board in the recess 8 of the connector. In order for the projections to be reliable and durable, it is important that the projections have the strength characteristics required to prevent failure thereof. It should be noted that the connector shown in FIG. 1 is shown by way of example, the present invention can be used with many various connectors.

Figure 2:
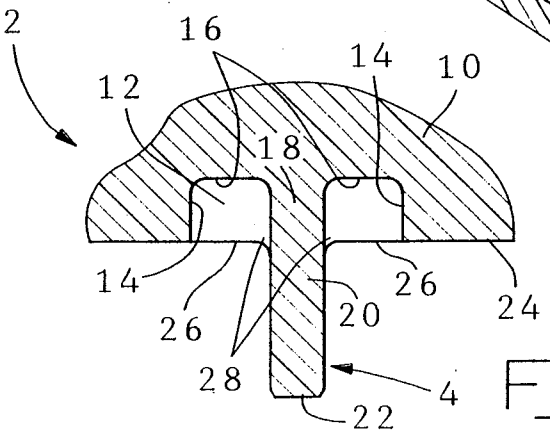
FIG. 2 is a fragmentary cross-sectional view of a post of the connector which has ribs extending from the housing of the connector to cooperate with the post.
Figure 3:
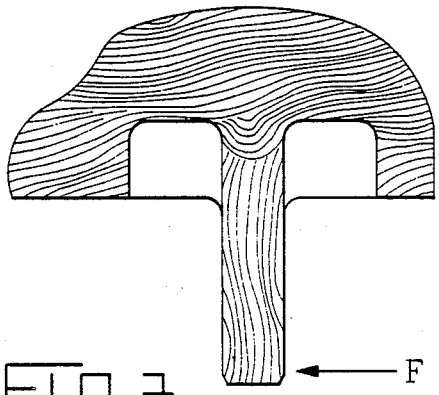
FIG. 3 is a view of the post of the connector, similar to FIG. 2, showing a representation of how the reinforcement fibers flow in the housing and the post.

As is shown in FIGS. 2 and 3, mounting post 4 extends from housing 10 of connector 2. Housing 10 has a cavity 12 provided therein. The cavity has side surfaces 14 and a bottom surface 16.

A fixed end portion 18 of post 4 is provided proximate bottom surface 16 and is integral therewith. Extending from fixed end portion 18, in a direction which is away from bottom surface 16, is a midportion 20 of post 4. The side surfaces of midportion 20 are essentially parallel to side surfaces 14 of cavity 12. A free end portion 22 of post 4 extends from midportion 20 in a direction which is away from fixed end portion 18. Free end portion 22 extends beyond a first major surface 24 of housing 10.

Figure 4:
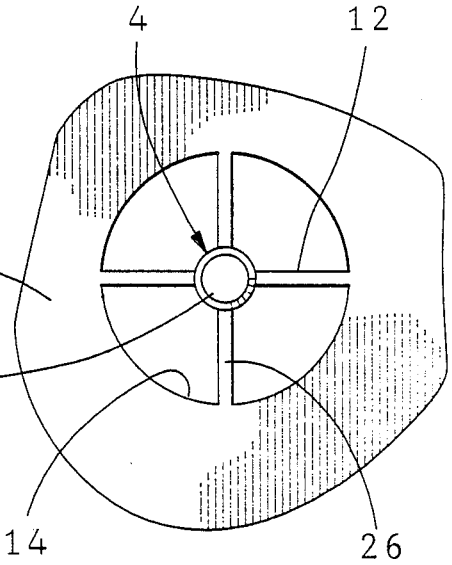
FIG. 4 is a bottom view of the post and a portion of the housing, showing four ribs extending from the housing to cooperate with the post.

Ribs 26 extend from side surfaces 14 of cavity 12 toward midportion 20 of post 4. Ends 28 of ribs 26 are provided adjacent the side surfaces of midportion 20. In fact, in many instances ends 28 are integral with midportion 20 to provide the strength characteristics required. The longitudinal axis of ribs 26 are essentially parallel to bottom surface 16 of cavity 12. As is shown in FIG. 4, four ribs 26 are provided about the circumference of post 4. The number of ribs positioned about the circumference of post 4 can vary according to the strength characteristics required.

As connector 2 is positioned on a printed circuit board 30, posts 4 cooperate with openings 32 to align the connector is the proper position. Due to manufacturing tolerances and the like, posts 4 are not always provided in exact alignment with openings 32. Consequently, as posts 4 are inserted into openings 32, forces could be applied to the posts by the openings. These forces have components which are essentially perpendicular to the longitudinal axis of the posts, as represented by F in FIG. 8.

Referring to FIG. 9, the application of force F to a free end portion 22' of a post 4' of the prior art, will cause the post 4' to pivot about fixed end portion 18'. For ease of understanding, the same numerals used to describe the present invention, with a prime mark positioned thereafter, will be used to describe the prior art mounting post.

As a force F is applied to the free end portion of the post, a moment is created about the portion of the terminal which is fixed. In the prior art, the fixed end portion 18' of the post 4' is the point about which the moment is applied.

FIG. 9 illustrates the flow of the fibrous material when the prior art connector 2' is molded. As can be seen in the figure, the flow of material into post 4' is essentially perpendicular to the flow of material in the housing 10'. The transition section between the varied flows occurs at the fixed end portion 18'. This transition section provides a weak section, in which the material is prone to failure. This is due to the irregular distribution of the reinforcement fibers of the material at fixed end portion 18'. Consequently, when a force is applied to free end portion 22' of post 4', the moment about fixed end portion 18, results is tensile stresses being applied to the fixed end portion. These stresses cause the post to crack (as indicated at C in FIG. 9) at the fixed end portion, which results in the failure of the post. This is an unacceptable result.

In contrast, the post 4 of the present invention does not fail when a force F is applied to the free end portion 22 thereof. Unlike the post 4, of the prior art, the post 4 of the present invention has the moment applied to the midportion 20 of the post, rather than to the fixed end portion 18.

As a force F is applied to free end portion 22 of post 4, the post cooperates with ribs 26. As ribs 26 are provided adjacent post 4, the application of force F to free end portion 22 causes post 4 to move into engagement with respective ribs 26. Upon engagement of post 4 with ribs 26, the ribs and the midportion act as the fixed portion of the post. Consequently, the moment is applied to the midportion 20 and ribs 26.

It should be noted that the application of force F to end portion 22 of post 4 may also cause the ribs to compress or flex, thereby providing a more resilient post. If this occurs, the stresses associated with the force will be distributed over a greater length. As plastic material maintains it integrity better during compression, the ribs will not fail as a force is applied to the end portions.

The moment being distributed about midportion 20 and ribs 26 is a desired result. As is shown in FIG. 3, the flow of the reinforcement fibers through the midportion 20 of post 4 is uniform and consistent. This flow is essentially parallel to the longitudinal axis of the post. Thus, no weak portions are provided in midportion 20 which are prone to failure. Therefore, as the moment is applied to the midportion, the strength of material provided in the midportion is able to withstand the stresses associated with the moment. Consequently, a much more reliable post is provided, i.e. one which will not fail during normal use. It should be noted that the flow of the reinforcement fibers shown in FIGS. 3, 6, and 9 is meant to be a representation of the actual flow. In reality, the transition between the weak portion and the post would not be as well defined. In other words, there would not be one harsh transition line as shown in the figures, rather the transition would be more gradual.

Consequently, positioning post 4 in cavity 12 and providing ribs 26 about the circumference of midportion 20 of the post provides for a much more reliable connector. The positioning of the cavity and ribs about the entire circumference of the post, enables the ribs to cooperate with the post no matter in which direction the force is applied to the free end portion of the post. Therefore, the configuration of the posts of the present invention insures that the posts will be structurally able to withstand the forces associated with insertion and transportation of the connector.

As is shown in FIG. 1, latches 6 are provided on opposite ends of housing 10, proximate the ends of recess 8. The latches are used to latch a matable printed circuit board (not shown) in position in recess 8.

Figure 5:
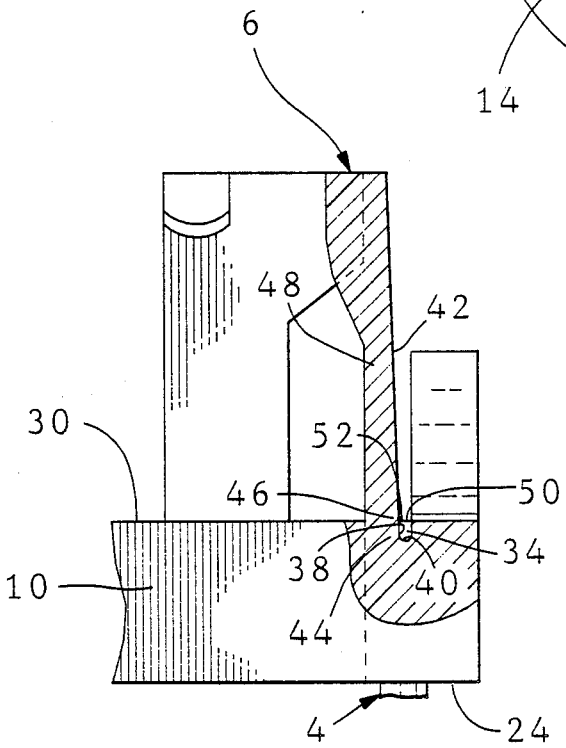
FIG. 5 is a fragmentary cross-sectional view of a latching means of the connector which has ribs extending from the housing of the connector to cooperate with the latching means.

As shown in FIG. 5 and 6, housing 10 has a cavity 34 provided in a second major surface 36 thereof. The cavity 34 has side surfaces 38 and a bottom surface 40. Latch 6 is provided adjacent cavity 34, such that a portion of side surface 42 of latch 6 is also a respective side surface 38 of cavity 34.

A fixed end portion 44 of latch 6 is provided proximate bottom surface 40 of cavity 34. Extending from fixed end portion 44, in a direction which is away from bottom surface 40, is a intermediate portion 46 of latch 6. A free end portion 48 of latch 6 extends from intermediate portion 46 in a direction which is away from fixed end portion 44. Free end portion 48 extends beyond second major surface 36 of housing 10.

Side flanges 50 extend from side surfaces 38 of cavity 34 toward intermediate portion 46. Ends 52 of side flanges 50 are provided adjacent or integral with side surface 42 of intermediate portion 46. The longitudinal axis of side flanges 50 are essentially parallel to the second major surface 36 of housing 10. As is shown in FIG. 7, two side flanges 50 are provided proximate side surface 42. The number of ribs positioned proximate latch 6 can vary according to the strength characteristics required.

As a matable printed circuit board is moved into recess 8 of connector 2, the printed circuit board engages free end portion 48 of latch 6, causing free end portion 48 to move outward, away from the line of insertion of the printed circuit board. Consequently, as the printed circuit board is inserted into the connector, forces are applied to the latches. These forces have a major component which is essentially perpendicular to the longitudinal axis of the latch.

The operation of latch 6 and side flanges 50 is essentially the same as the operation of post 4 and ribs 24. As a force F is applied to the free end portion 48, the latch cooperates with side flanges 50. As side flanges 50 are provided adjacent intermediate portion 46 of latch 6, the application of force F to free end portion 48 causes latch 6 to cooperate with side flanges 50. Therefore, as the force is applied, the side flanges and intermediate portion 46 act as the fixed portion of the latch. Consequently, the moment is applied to the intermediate portion 46.

It should be noted that the application of force F to end portion 48 of latch 6 may also cause the side flanges to compress or flex, thereby providing a more resilient latch. If this occurs, the stresses associated with the force will be distributed over a greater length. As plastic material maintains it integrity better during compression, the side flanges will not fail as a force is applied to the end portions.

The moment being distributed about intermediate portion 46 is a desired result. As is shown in FIG. 6, the flow of the reinforcement fibers through the intermediate portion 46 is uniform and consistent. This flow is essentially parallel to the longitudinal axis of the latch. Thus, no weak portions are provided in intermediate portion 46 which are prone to failure. Therefore, as the moment is applied to the intermediate portion, the strength of material provided in the intermediate portion is able to withstand the stresses associated with the moment. The configuration of the latches of the present invention insures that the latches will be structurally able to withstand the forces associated with the insertion and removal of the mating printed circuit board from the recess of the connector.

Changes in construction will occur to those skilled in the art and various apparently different modifications and embodiments may be made without departing from the scope of the invention. The matter set forth in the foregoing description and accompanying drawings is offered by way of illustration only.

I claim:

1. A connector comprising:

a housing having a first surface and a second surface;

a cavity provided in the housing, the cavity extending from the first surface toward the second surface, the cavity having cavity side surfaces and a cavity bottom surface;

a projection provided proximate the cavity bottom surface, the projection extends from the cavity bottom surface toward the first surface, the projection extends beyond the first surface, such that a free end portion of the projection is provided beyond the housing, a midportion of the projection extends from the free end portion to a fixed end portion which is proximate the cavity bottom surface;

ribs which extend into the cavity, at a position which is proximate the first surface of the housing, the ribs extend from the cavity side surfaces toward the projection, ends of the ribs are provided adjacent the midportion the projection;

whereby as forces are applied to the free end portion of the projection, the midportion of the projection cooperates with the ribs so that the forces are distributed through the midportion, thereby preventing the failure of the projections.

2. A connector as recited in claim 1 wherein the fixed end portion of the projection is integral with the bottom surface of the cavity.

3. A connector as recited in claim 1 wherein the cavity is provided about the entire circumference of the projection, the projection having side walls which are essentially parallel to the cavity side surfaces.

4. A connector as recited in claim 3 wherein the ribs which extend from the cavity side surfaces toward the projection are essentially perpendicular to the cavity side surfaces.

5. A connector as recited in claim 4 wherein four ribs are provided about the circumference of the recess.

6. A connector as recited in claim 1 wherein the cavity is provided adjacent the projection.

7. A connector as recited in claim 1 wherein the ribs which extend from the cavity side surfaces toward the projection are essentially perpendicular to the cavity side surfaces.

8. A connector of the type comprising a housing which has a first major surface and an oppositely facing second major surface, the connector comprising:

a cavity provided in the first major surface and extending toward the second major surface, the cavity having a bottom surface which is spaced from the first major surface;

a projection means extending from proximate the bottom surface of the cavity beyond the first major surface of the housing, the projection means having a fixed end portion which is provided proximate the bottom surface of the cavity and a free end portion which is provided beyond the first major surface of the housing, and an intermediate portion which extends between the fixed end portion and the free end portion;

rib means extend from the housing into the cavity proximate the first major surface, the rib means are provided to cooperate with the projection means;

whereby as forces are applied to the free end portion of the projection means, the forces are distributed to the intermediate portion of the projection means, preventing the projection means from pivoting about the fixed end portion, thereby, insuring that the projection means will not fail as a force is applied thereto.

9. A connector as recited in claim 8 wherein the rib means extend from cavity side surfaces toward the projection means, the rib means extending in a plane which is essentially parallel the first major surface of the connector.

10. A connector as recited in claim 8 wherein the projection means is a post which extends from the connector.

11. A connector as recited in claim 8 wherein the projection means is a latch which extends from the connector.

12. A molded connector comprising:

a housing having a first surface and a second surface;

a cavity provided in the first surface and extending toward the second surface, the cavity having a cavity bottom surface spaced from the first surface;

a projection means extending from proximate the bottom surface of the cavity beyond the first surface, the projection means having a relatively weak fixed end portion, a free end portion, and an intermediate portion, the fixed end portion is proximate the bottom surface of the cavity;

rib means extending from the housing into the cavity proximate the first surface, the rib means cooperate with the intermediate portion of the projection means;

whereby as a force is applied to the second end portion of the projection means, the intermediate portion engages the rib means, preventing stresses from being transferred to the weak fixed end portion of the projection means, thereby insuring that the weak fixed end portion will not fail when a force is applied to the free end portion.

13. A molded connector as recited in claim 12 wherein the rib means have free ends which are provided adjacent the intermediate portion of the projection means.

14. A molded connector as recited in claim 12 wherein the rib means extend from cavity side surfaces toward the projection means, the rib means extending in a plane which is essentially parallel the first surface of the connector.

15. A molded connector as recited in claim 12 wherein the projection means is a post which extends from the connector.

16. A molded connector as recited in claim 12 wherein the projection means is a latch which extends from the connector.

* * * * *